US005233142A

United States Patent [19]

Dunham

[11] Patent Number: 5,233,142

[45] Date of Patent: Aug. 3, 1993

[54] SNAP ACTION ELECTRICAL SWITCHING MECHANISM WITH DUAL SET POINTS

[75] Inventor: Lawrence A. Dunham, Northridge, Calif.

[73] Assignee: ITT Corporation, New York, N.Y.

[21] Appl. No.: 876,647

[22] Filed: Apr. 30, 1992

[51] Int. Cl.[5] ..... H01H 35/38

[52] U.S. Cl. ..... 200/83 J; 73/745; 200/81.4; 200/82 R

[58] Field of Search ..... 200/82 R, 83 R, 83 J, 200/83 N, 83 T, 83 P, 81.4; 307/118; 340/626; 73/717, 723, 729, 745

[56] References Cited

U.S. PATENT DOCUMENTS

| | | | |
|---|---|---|---|
| 3,668,347 | 6/1972 | Korsgren | 200/83 WM |
| 3,876,845 | 4/1975 | Griffith | 200/83 P |
| 4,225,760 | 9/1980 | Griffith | 200/83 R |
| 4,757,165 | 7/1988 | Marcoux | 200/83 P |
| 4,794,214 | 12/1988 | Sanford | 200/83 P |
| 4,853,504 | 8/1989 | Tanaka | 200/83 P |
| 5,004,873 | 4/1991 | Schnut | 200/83 P |

*Primary Examiner*—Gerald P. Tolin
*Attorney, Agent, or Firm*—Menotti J. Lombardi

[57] ABSTRACT

A first belleville spring, having a given preload, controls a translatable, elongate, contact disc assembly, to cause a shunting disc to remove from, and close into contact with a pair of circuit contacts. The assembly is disposed within a translatable carriage, and a second belleville spring having a greater preload controls translation of the carriage, to cause the shunting disc to close into contact with, and remove from, a second pair of circuit contacts. As a consequence dual set points of switching operation is provided. A fluid medium, admitted into a housing for the assembly and carriage, effects translation of the assembly and carriage.

11 Claims, 1 Drawing Sheet

SNAP ACTION ELECTRICAL SWITCHING MECHANISM WITH DUAL SET POINTS

BACKGROUND OF THE INVENTION

This invention pertains to electrical switches of a type having snap action, and in particular to an electrical switching mechanism which offers the snap action and dual set points.

There have been temperature or pressure actuated switches or switching mechanisms which use belleville-type springs for resisting actuation, in order to give the same an operating, snap action. Exemplary thereof is U.S. Pat. No. 4,853,504, issued to Hazime Tanaka et al, on Aug. 1, 1989, for a Triple Action Pressure Switch. This patented switch employs snap disc assemblies to open and close resiliently supported contacts. Such switches, it is found, are susceptible to faulty operation and functioning due to vibration, shock and the like. Another reference of interest is U.S. Pat. No. 5,004,873, issued on Apr. 2, 1991, to Robert H. Schnut, for Plural Set Point Pressure Responsive Switching Apparatus Utilizing a Single Pressure Sensing Driver. In this apparatus, a belleville snap spring is employed to actuate and deactuate microswitch-type elements. The snap spring translates an actuator which, in turn, actuates the aforesaid elements, and the latter elements, in turn, open and close electrical circuits. Such sequential functioning invites failures, and requires considerable maintenance.

In U.S. Pat. No. 3,876,845, issued on Apr. 8, 1975, to Donald L. Griffith and Lawrence A. Dunham, for Pressure and Temperature Actuated Switches Utilizing Belleville springs, is disclosed a belleville spring-actuated switch which is not susceptible to malfunctioning due to shock or vibration. Too, the switch comprises fixed contacts, and an actuator which carries a shunting disc for direct make or break contact with the fixed contacts. What has been needed is an electrical switching mechanism, similar to the aforecited U.S. Pat. No. 3,876,845, which, however, will offer dual set-points.

SUMMARY OF THE INVENTION

It is an object of this invention to set forth an electrical switching mechanism, pressure, or temperature actuated, which uses belleville springs, pursuant to the teaching in the aforecited U.S. Pat. No. 3,876,845, but which presents a novel structure in which two electrical circuits are switched at two different, and predetermined pressures or forces.

Particularly, it is an object of this invention to disclose an electrical switching mechanism comprising a housing; wherein said housing has means for admitting a pressured fluid medium thereinto; a first pair of electrical contacts, mounted within said housing, having terminal ends thereof lying in a first plane; a second pair of electrical contacts, mounted within said housing, having terminal ends thereof lying in a second plane; a shunting, contact disc, movably disposed within said housing and interposed between said first and second pairs of contacts; and means confined within said housing (a) for constraining said disc in one of said planes in normal engagement with said ends of one of said pairs of contacts, and (b) for instantly, with snap action, displacing said disc from said engagement and said one plane, and instantly, with snap action, moving said disc to the other of said planes and into engagement with said ends of said other pair of contacts, in response to admittance of fluid medium at first and second thresholds of pressure, respectively.

It is also an object of this invention to set forth an electrical switching mechanism comprising a housing; wherein said housing has means for admitting a fluid medium thereinto; a first pair of electrical contacts, mounted within said housing, having terminal ends thereof lying in a first plane; a second pair of electrical contacts, mounted within said housing, having terminal ends thereof lying in a second plane; a carriage, movably disposed within said housing; an abutment, within said housing, for delimiting movement of said carriage; and an elongate, contact disc assembly, movably disposed within said carriage; wherein said assembly has piston means, at one end thereof, and disposed in immediate adjacency to said medium admitting means, for moving said assembly in response to an admittance of fluid medium into said housing; said assembly further has a contact disc, at the opposite end thereof, interposed between said first and second pairs of contacts; said carriage has an abutment thereon for delimiting movement of said assembly therewithin; first means confined within said housing, and engaged with said assembly, for (a) constraining said disc in contact with one of said first and second pairs of contacts, and (b) restraining said assembly against movement thereof relative to said carriage; and second means disposed within said housing, and engaged with said carriage, for restraining said carriage against movement thereof relative to said housing.

BRIEF DESCRIPTION OF THE DRAWING

Further objects of this invention, as well as the novel features thereof, will become apparent by reference to the following description, taken in conjunction with the accompanying FIG. 1, the same being an axial, cross-sectional view of the invention according to an embodiment thereof.

The novel, electrical, switching mechanism 10, has a cylindrical shell 12 which is threaded at the left-hand end where a correspondingly threaded mounting header 14 is threadedly engaged. At the opposite, right-hand end of the shell 12, an end adapter 16 is joined by weld. The adapter 16 receives an electrical connector 18. Within the shell 12, the connector 18 has wiring terminals 20. Welded to an inner face of the header 14 is an open-ended cylinder 22. The remote, open end of the cylinder 22 is internally threaded and has a threaded platform 24 engaged therewith. The platform 24 mounts a pair of electrical contacts 26 therein, the latter being fixed in place, in parallel, in insulating sleeves 28. Inwardly-projecting, terminal ends of the contacts 26 lie in a plane "A", and the outwardly-extending portions thereof are joined to wires 30.

Figure 1:
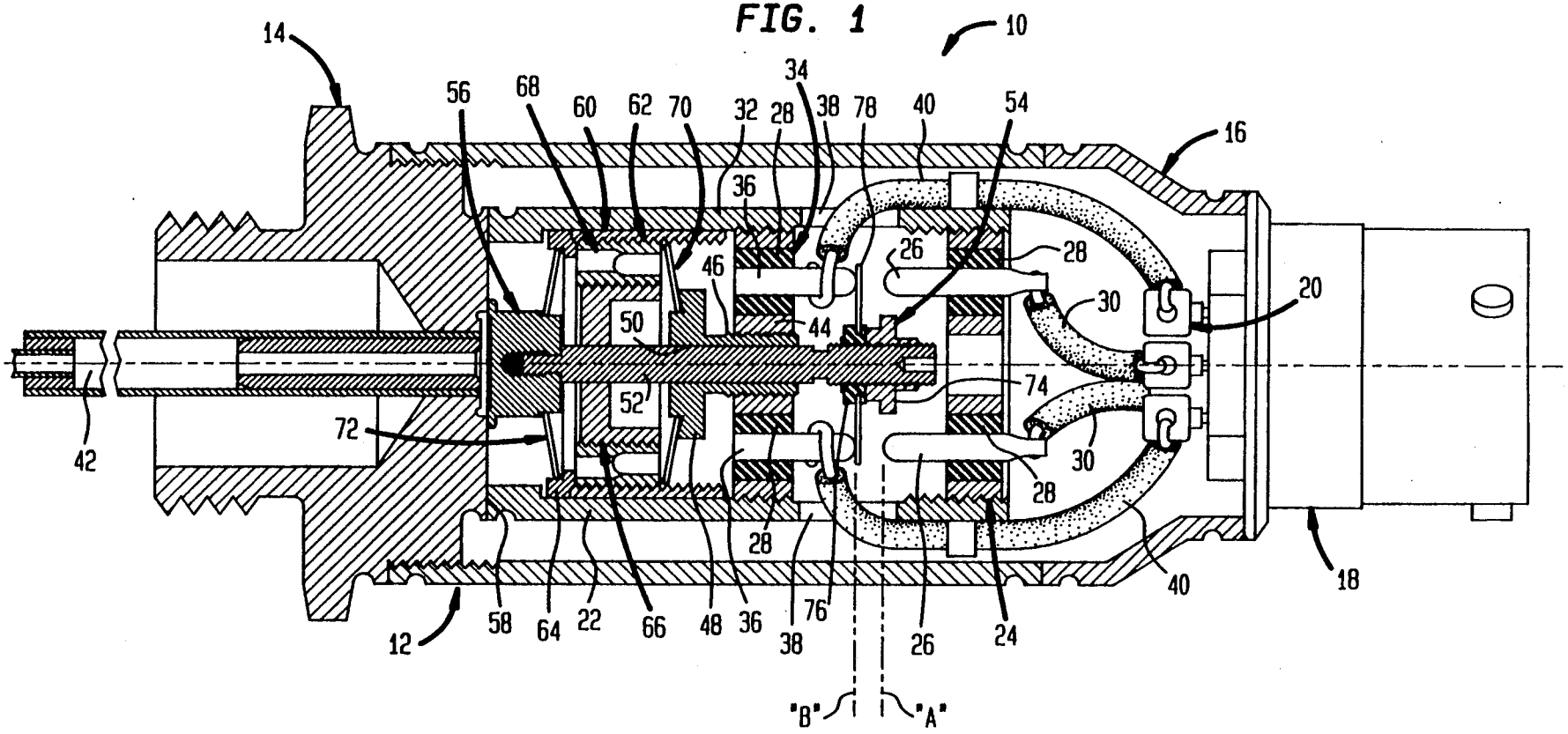

Intermediate the length of the cylinder 22 is an inner threaded, annular portion 32. Another threaded platform 34 is threadedly joined to portion 32, and mounts a second pair of electrical contacts 36. Adjacent to threaded, annular portion 32, the cylinder 22 has a pair of apertures 38 through which further wires 40 penetrate and are electrically bound to the contacts 36. Contacts 36, too, are fixed in place, in platform 34 in additional insulating sleeves 28. Terminal ends of the contacts 36, which confront the terminal ends of contacts 26, lie in a plane "B".

Header 14 mounts, centrally therein, a conduit 42 for admitting a fluid medium therethrough and into the cylinder 22. Platform 34 has a threaded, central bore 44, and threaded thereinto is the shank 46 of a support 48. Support 48, and its shank 46, have a throughgoing bore 50 formed therein, and slidably receives therein a shaft 52 of an elongate, contact disc assembly 54. At the left-hand end of shaft 52 there is mounted a piston head 56. The latter is disposed in immediate adjacency to the innermost end of conduit 42. Fixed to the inner face of the header 14, to isolate the piston head 56 from admitted fluid medium, is a diaphragm 58.

Set within the inner or left-hand end of the cylinder 22 is a carriage 60. The same comprises an outer, internally threaded sleeve 62, an innermost, annular, belleville spring retainer 64, a cup-shaped, centrally-bored, and externally threaded abutment member 66. Interpositioned between, and threadedly engaged with, member 66 and sleeve 62, is a dual-walled, annular element 68 which nests therein the outer periphery of a belleville spring 70. The inner periphery of the spring 70 is nested in a groove provided therefor in the support 48. A second belleville spring 72 has its outer periphery nested in retainer 64, and its inner periphery set about a reduced diameter portion of piston head 56.

Contact disc assembly 54 has, at its right-hand end, a disc holder 74. The latter is threadedly coupled to the correspondingly threaded end of shaft 52, and has an annular insulation piece 76 thereat. An electrically-conducting disc 78 is mounted upon the insulation piece 76, and as shown lies along plane "B" in electrically-contacting or shunting engagement with the contacts 36. Consequently, disc 78 completes a circuit through wires 40 and contacts 36. This is the normal or quiescent state of the mechanism 10.

Belleville spring 72 is outwardly biased, as shown, to hold the piston head 56 against the diaphragm 58 and inner face of the header 14 with a given preload. Upon a pressured fluid medium having greater force than such preload being introduced into the housing, i.e., shell 12 and cylinder 22, behind the diaphragm 58, via the conduit 42, the spring 72 snaps inwardly, instantly to move the contact disc assembly 54 to the right. As a result of this, the piston head 56 meets the abutment presented by abutment member 66, and the shunting disc 78 withdraws from plane "B" and the terminal ends of contacts 36. At this time, the belleville spring 70 is stressed, but does not yield to the pressure; it has a higher preload than has spring 72. The carriage 60, then, which is only slidably disposed in the cylinder 22, remains in place, held by spring 70.

If the pressure of the fluid medium is diminished, or the medium itself is evacuated, the spring 72 returns to its normal, preloaded disposition, and snaps the contact disc assembly 54 back to the normal, quiescent state, as shown in the figure, with the disc 78 in shunting engagement with the contacts 36.

If the pressure of the fluid medium is increased, beyond the preload of belleville spring 70, then this spring yields and, with a snap action, carries the carriage 60 rightward until the inner, annular end of sleeve 62 meets the abutment presented by platform 34, and the contact disc assembly 54 moves along therewith. Now, in this circumstance, the disc 78 occupies plane "A" and is in shunting engagement with the contacts 26.

Again, if the pressure of the fluid medium is diminished to a level between the threshold at which it causes the spring 70 to yield, and the threshold at which it causes the spring 72 to yield, spring 70 will snap back to its normal attitude, and retract the carriage 60. Spring 72 however will still be flexed, as the assumed pressure level will not permit it to relax. Consequently, the disc 78 will be between planes "A" and "B", and will remain thereat until the pressure of the fluid medium diminishes to the below threshold level at which spring 72 can snap back to its relaxed attitude.

It is to be noted that when the carriage 60 is snapped to the right, by the yielding of spring 70, it carries the abutment of abutment member 66 therewith. As a consequence, with the concomitant flexing of spring 72, the piston head 56 can translate further into the shell 22. This is how it is that the disc 78 succeeds to plane "A" and shunting contact with contacts 26.

The contacts 26 and 36 are securely fixed in place, and the shunting disc 78, in the manner described in the forgoing, makes positive, instant contacting engagement therewith. No normal vibration, shock or the like, can cause the mechanism 10 to switch faultingly, or erringly disengage from contact. The mechanism 10 switches two electrical circuits at two different fluid medium pressures; hence, the mechanism 10 is useful for dual set point requirements: alarm and shutdown, or warning and shutdown, etc. It offers accuracy, repeatability and reliability not found in prior art dual set point switches or switching mechanisms. The mechanism 10 lends itself to infinite adjustment, for differing, selected pressures or set points, in that the shank 46 of the support 48 is axially adjustable in the platform 34, the disc holder 74 is threadedly adjustable on the shaft 52, platform 34 is axially adjustable within the cylinder 22 at portion 32, the threaded abutment member 66 is adjustable within annular element 68, and the latter is adjustable, axially, within the sleeve 62.

While I have described my invention in connection with a specific embodiment thereof, it is to be clearly understood that this is done only by way of example, and not as a limitation to the scope of the invention as set forth in the objects thereof and in the appended claims. For instance, herein pressured fluid medium is set forth as the motive force. Clearly, a liquid could be admitted via the conduit 42, a liquid which is heated giving rise to a pressure escalation thereof which moves the diaphragm 58 and displaces the piston head 56 as a consequence thereof. Therefore the mechanism would be temperature-actuated in the same manner as described herein for a pressured fluid medium admitted via the conduit 42.

I claim:

1. An electrical switching mechanism, comprising:

a housing; wherein said housing has means for admitting a fluid medium thereinto;

a first pair of electrical contacts, mounted within said housing, having terminal ends thereof lying in a first plane;

a second pair of electrical contacts, mounted within said housing, having terminal ends thereof lying in a second plane;

a carriage, movably disposed within said housing;

an abutment, within said housing, for delimiting movement of said carriage; and an elongate, contact disc assembly, movably disposed within said carriage; wherein said assembly has piston means, at one end thereof, and disposed in immediate adjacency to said medium admitting means, for moving said assembly in response to an admittance of fluid medium into said housing;

said assembly further has a contact disc, at the opposite end thereof, interposed between said first and second pairs of contacts;

said carriage has an abutment thereon for delimiting movement of said assembly therewithin;

first means confined within said housing, and engaged with said assembly, for (a) constraining said disc in contact with one of said first and second pairs of contacts, and (b) restraining said assembly against movement thereof relative to said carriage; and second means disposed within said housing, and engaged with said carriage, for restraining said carriage against movement thereof relative to said housing.

2. An electrical switching mechanism, according to claim 1, wherein:

said abutment within said housing has an aperture formed therein, centrally thereof; and further including a support, mounted in said aperture; wherein said support has a throughgoing bore formed therein; and said assembly is slidably engaged with said bore.

3. An electrical switching mechanism, according to claim 1, further including:

a support mounted to said abutment within said housing; and wherein said second means is mounted on said support.

4. An electrical switching mechanism, according to claim 1, wherein:

said first means is interposed between said piston means and said carriage.

5. An electrical switching mechanism, according to claim 1, wherein:

one of said first and second means comprises a belleville spring.

6. An electrical switching mechanism, according to claim 1, wherein:

said first and second means comprise belleville springs.

7. An electrical switching mechanism, according to claim 1, wherein:

said abutment within said housing comprises means for supporting one of said pairs of electrical contacts within said housing.

8. An electrical switching mechanism, according to claim 1, further including:

means interposed between said housing and said piston means for isolating said piston means from fluid medium admitted via said admitting means.

9. An electrical switching mechanism, according to claim 8, wherein:

said isolating means comprises a diaphragm.

10. An electrical switching mechanism, according to claim 1, wherein:

said housing is internally threaded; and said abutment within said housing is externally threaded, and adjustably threadedly engaged with such housing internal threads.

11. An electrical switching mechanism, according to claim 2, wherein:

said aperture is threaded;

said support has an externally threaded shank; and said shank is threadedly engaged with said aperture.

* * * * *